United States Patent [19]

Vrana

[11] 3,970,031

[45] July 20, 1976

[54] FLOATING OARS

[76] Inventor: Charles K. Vrana, 60 Helen Lane, Fort Myers Beach, Fla. 33931

[22] Filed: Apr. 7, 1975

[21] Appl. No.: 565,742

Related U.S. Application Data

[63] Continuation-in-part of Ser. No. 488,248, July 12, 1974, abandoned.

[52] U.S. Cl. ..... 115/21; 9/311; 115/19

[51] Int. Cl.[2] ..... B63H 16/00

[58] Field of Search ..... 9/301–307, 9/310 B, 310 E, 310 J, 311; 115/21, 22.1, 22.2, 22.3, 24.1, 24.2, 24.3, 24.4, 25, 26, 26.1, 26.3, 19; 416/74

[56] References Cited

UNITED STATES PATENTS

| | | | |
|---|---|---|---|
| 1,587,605 | 6/1926 | Scroggins | 115/26.1 |
| 2,693,605 | 11/1954 | Berlen | 416/74 |
| 2,733,680 | 2/1956 | Wagner | 115/21 |
| 3,135,977 | 6/1964 | Vidal | 416/74 |

FOREIGN PATENTS OR APPLICATIONS

| | | | |
|---|---|---|---|
| 1,036,729 | 8/1958 | Germany | 9/307 |

*Primary Examiner*—Duane A. Reger
*Assistant Examiner*—Jesus D. Sotelo

[57] ABSTRACT

This invention pertains to a floating oar device which includes a pair of floatation pads attached to a handle; each floatation pad provides a flap hinged thereto which close during each rearward power stroke and open during the retrieve phase of each stroke. The floating oar device may take any one of several forms which permit it to be used in a generally normal swimming attitude by a person in the water or in prone, sitting or standing attitudes on a float board.

6 Claims, 5 Drawing Figures

FLOATING OARS

This is a continuation in part of my abandoned application Ser. No. 488,248, filed July 12, 1974, entitled Floating Oar and Its Application.

FIELD OF THE PRESENT INVENTION

The present invention is directed to a floating oar device which utilizes water forces in the form of resistance to closed flap means during a power stroke to propel a person through the water while in the water, or while in prone, sitting or standing attitudes on a floatation board preferably formed of a water tight hollow plastic material or a synthetic foam material. The flap means opens during the retrieve stroke to minimize the water resistance forces.

OBJECTS AND ADVANTAGES OF THE PRESENT INVENTION

One of the principal objects of the present invention is to provide a floating oar to provide propulsion through the water for a swimmer in the water or in a prone, sitting or standing position on a floatation board.

Another principal object of this invention is to provide a floating oar which floats on the surface of the water at all times during both the power and retrieve phases of a complete backward and forward stroke. Therefore the oar is not physically "dug" into the water or raised therefrom during any phase of it operation.

A further object of this invention is to provide such an oar which includes pivotal flap means beneath floatation means which moves from a generally horizontal attitude during the retrieve portion of a stroke to a position slightly less than vertical during the power phase of the stroke.

Yet another object of the present invention is to provide a floating oar which normally sustains a non-swimmer on the surface of the water in addition to providing a propulsion means.

A still further object of this invention is to provide a low cost floatation propulsion oar which is simple in construction and operation.

DETAILED DESCRIPTION OF THE DRAWINGS

Figure 1:
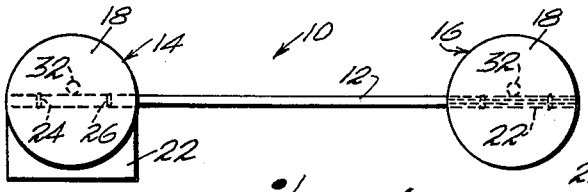
FIG. 1 is a top plan view of a basic form of the floating oar in accordance with the present invention.
Figure 2:
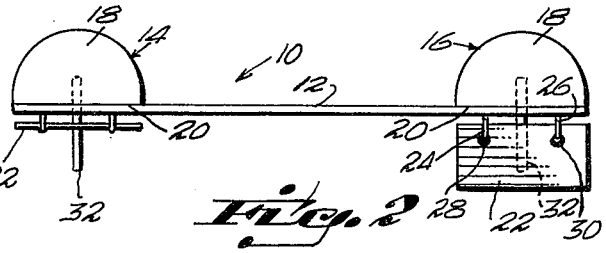
FIG. 2 is a side elevational view of FIG. 1.

With reference to the drawings in which like reference characters designate like or corresponding parts throughout the various views and with particular reference to FIGS. 1 and 2 a basic form of the floating oar is indicated generally at 10. The oar 10 includes handle bar means 12 carrying a combination floatation propulsion means 14 and 16, fixed relative to the opposed ends thereof.

Each of the floatation propulsion means comprises a semi-spherical or similar floatation pad 18 with a flat bottom 20 fixed in any convenient manner to one end of the handle bar means 12. In use the device will float flat bottom down as viewed FIG. 2.

Hingedly connected relative to the flat bottom of each floatation pad 18 is a propulsion flap 22 in longitudinal alignment with the handle bar means 12. Each flap 22 may be pivotally hinged as by a pair of screw-eyes 24 and 26 engaged through appropriate holes 28 and 30 in the upper edge portion of a flap 22. Just behind each flap 22 a downwardly extending stud 32 from each pad 18 limits the downwardly pivotal movement of the flap to a slightly less than a vertical position, 85 degrees by way of example.

In use, a swimmer grasps the handle bar means 12 in both hands adjacent the respective pads 18, and pivotally skims said pads 18 alternately back and forth along the surface of the water. The pad 18 being retracted provides the power by means of its associated flap 22, which pivots forwardly to its downward position against stud 32. Because of the slightly less than vertical position of the flap, it tends to dig into the water. The opposite flap 22, pivotally connected to the opposite pad 18, while being moved forwardly, pivots rearwardly away from its associated stud 32 to a generally horizontal attitude wherein it encounters a minimal water resistance. In this manner a continuous pivotal movement of the device along the surface of the water, effectively moves the swimmer forwardly in the water.

Figure 3:
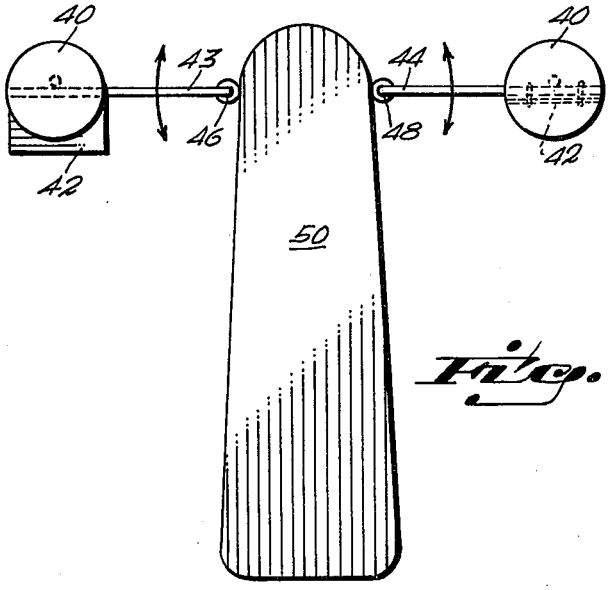
FIG. 3 is a top plan view of a first modified form of the invention, incorporating a floatation board.

With reference to FIG. 3, the respective semi-spherical pads 40 and associated flaps 42 are constructed and operate in the same manner as in the form disclosed in FIGS. 1 and 2. However, the two pads 40 are carried by individual handle bar means 43 and 44 pivotally connected as at 46 and 48 to opposite sides of the forward end portion of a floatation board 50. Floatation "board"50 may also be of inflatable material.

In operation, a person lies prone on the floatation board 50 and operates the two pads 40 by means of handle bar means 43 and 44 alternately forwardly and backwardly to provide the forward propulsion through the water in the same manner as described relative to FIGS. 1 and 2.

Figure 4:
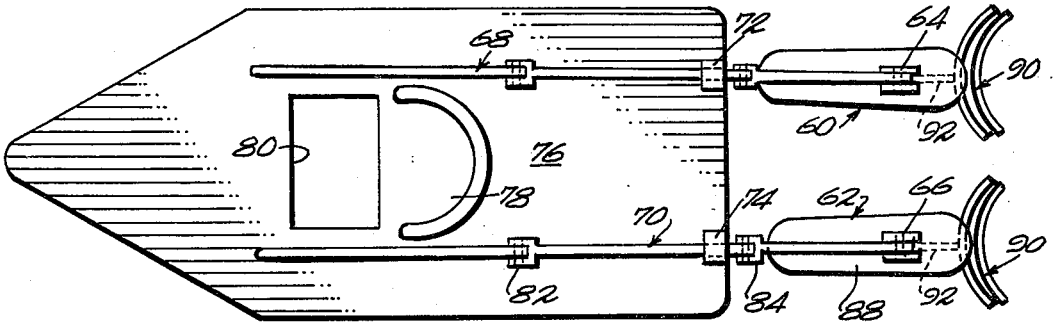
FIG. 4 is a top plan view of a second modified form of the invention, incorporating a floatation board.
Figure 5:
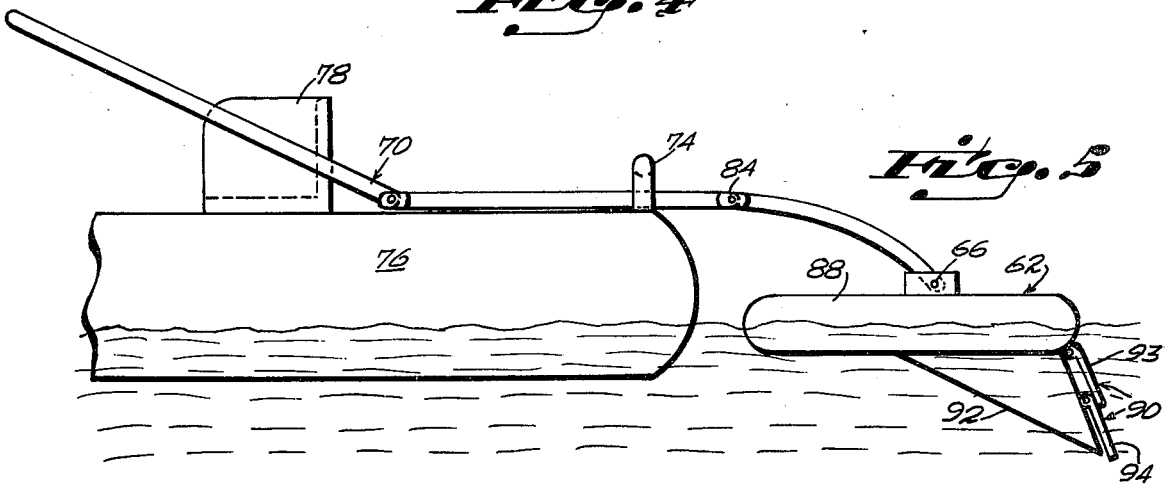
FIG. 5 is a side elevational view of FIG. 4, illustrating the device floating in water.

With reference to FIGS. 4 and 5, a pair of floating oars 60 and 62 are pivotally connected at 64 and 66 to individual handle bar means 68 and 70 extending rearwardly in a generally parallel relationship through inverted U-shaped guide means 72 and 74, fixed atop the rear end of a floatation board 76. The floatation board 76 may include a seat portion 78 for the operator and an opening 80 forwardly thereof for downward passage therethrough of the feet and lower legs.

The respective handle bar means 68 and 70 extend forwardly and rearwardly of and to opposite sides of the operator and each includes two pivot joints 82 and 84 in addition to its pivot connection 64 or 66 to its respective floating oar 60 or 62.

Each floating oar 60 and 62 includes a floatation member 88 and flap means 90 pivotally connected thereto by means of a keel portion 92. The flap means 90 may comprise a single large flap as in FIGS. 1, 2 and 3, or two smaller flaps 90 and 94 as illustrated.

In operation, the operator may stand or seat himself or herself in the seat portion 78 and alternately reciprocate the floating oars 60 and 62 forwardly and rearwardly to accomplish the forward propulsion across the surface of the water. The floating oars 60 and 62 and associated flap means 93 and 94 operate in the same manner as described relative to FIGS. 1, 2 and 3.

Alternatively, the operator may operate both oars in unison on all three forms of the invention illustrated and described to accomplish a greater rate of speed. In other words, both floating oars would be simultaneously moved rearwardly in power strokes and forwardly in recovery strokes. To accomplish a turn, one side or the other would be operated individually depending upon whether a right or left turn is desired. In both forms of operation, all three forms of the device supports the operator in the water.

What is claimed is:

1. A floating oar device for propelling a person through the water comprising handle bar means, a floatation pad fixed relative to each outer end of said handle bar means, flap means pivotally connected along their upper edges relative to bottom surfaces of the respective floatation pads whereby said flap means alternately pivot downwardly and upwardly to substantially vertical and horizontal positions relative to respective rearward and forward movement of said floatation pads along the surface of the water, and means to limit said downward pivotal movement, said handle bar means comprises a pair of handle bars, each carrying one of said floatation pads and associated flap means on an outer extended end thereof, the inner ends of said pair of bars being operably restrained and positioned relative to a person, supported on an elongated floatation board, said floatation pads and flap means being located rearwardly of said floatation board.

2. The floating oar as defined in claim 1 wherein said pair of handle bars are disposed in a spaced apart generally parallel longitudinal relation, pivotally connected at their outer rear ends to respective floatation pads, said elongated floatation board having a pair of handle bar guide means fixed thereto in a spaced apart relation adjacent its rear end, said pair of handle bars extending through said guide means to forward ends positioned somewhat rearwardly of the front end of said floatation board.

3. The floating oar as defined in claim 2 wherein each handle bar is comprised of three bar lengths pivotally attached together, the rear length of said three being curved downwardly to position its associated floatation pad and flap means in the water when in use.

4. The floating oar as defined in claim 3 including a seat portion located generally centrally at the top of said floatation board between the front end lengths of said pair of handle bars, and a hole through said floatation board forwardly of said seat portion.

5. The floating oar as defined in claim 4 wherein flap means are arcuately rearwardly configurated.

6. The floating oar as defined in claim 5 wherein said flap means comprises a pair of flaps transversely pivoted along their top edges to the trailing edge of a keel member extending downwardly from the bottom face of each floatation pad.

* * * * *